US011231160B1

(12) United States Patent
Zhang

(10) Patent No.: US 11,231,160 B1
(45) Date of Patent: Jan. 25, 2022

(54) RGBW LED WITH INTEGRATED LENS DEVICE

(71) Applicant: Bruce Zhang, Orlando, FL (US)

(72) Inventor: Bruce Zhang, Orlando, FL (US)

(73) Assignee: Everylite, Orlando, FL (US)

( * ) Notice: Subject to any disclaimer, the term of this patent is extended or adjusted under 35 U.S.C. 154(b) by 0 days.

(21) Appl. No.: 16/920,284

(22) Filed: Jul. 2, 2020

(51) Int. Cl.

| | |
|---|---|
| ***F21V 5/04*** | (2006.01) |
| ***F21V 23/00*** | (2015.01) |
| ***F21Y 113/10*** | (2016.01) |
| ***F21Y 115/10*** | (2016.01) |

(52) U.S. Cl.
CPC ..... *F21V 5/04* (2013.01); *F21V 23/002* (2013.01); *F21V 23/008* (2013.01); *F21Y 2113/10* (2016.08); *F21Y 2115/10* (2016.08)

(58) Field of Classification Search
CPC ..... F21V 5/04; F21V 23/008; F21V 23/002; F21Y 2115/10; F21Y 2113/10; F21Y 2113/13; F21Y 2103/10
See application file for complete search history.

(56) References Cited

U.S. PATENT DOCUMENTS

| | | | | |
|---|---|---|---|---|
| 8,230,575 | B2 * | 7/2012 | Veenstra | H05K 5/064 29/592.1 |
| 8,779,459 | B2 * | 7/2014 | Takeda | F21V 23/002 257/99 |
| 10,375,791 | B2 * | 8/2019 | Farnsworth | H05B 47/19 |
| 2006/0187652 | A1 * | 8/2006 | Doyle | F21S 8/022 362/96 |
| 2008/0310156 | A1 * | 12/2008 | Wang | F21V 31/04 362/231 |
| 2016/0265742 | A1 * | 9/2016 | Wang | F21V 5/007 |
| 2020/0173645 | A1 * | 6/2020 | Singh | F21V 33/0088 |

* cited by examiner

*Primary Examiner* — Peggy A Neils
(74) *Attorney, Agent, or Firm* — Jason T. Daniel, Esq.; Daniel Law Offices, P.A.

(57) ABSTRACT

A RGBW LED with integrated lens device includes two RGB LED's that are positioned adjacent to a single-color LED. A backer having a plurality of openings is positioned along the bottom of the LED's, and a plurality of cables are routed through the sides of the backer. A unitary clear lens body having a top wall, and a continuous sidewall extending downward therefrom to form an interior space. Three domes are formed along the top wall of the lens, and a lip is formed along the sidewall within the inside surface of the lens. The backer is positioned within the interior space of the lens along the lip, and each of the LED's are positioned within a single dome. Glue is poured through the plurality of openings to fill the interior space of the lens body to secure the device components in a watertight manner.

16 Claims, 5 Drawing Sheets

RGBW LED WITH INTEGRATED LENS DEVICE

TECHNICAL FIELD

The present invention relates generally to light producing devices, and more particularly to an RGBW LED with integrated lens device.

BACKGROUND

The statements in this section merely provide background information related to the present disclosure and may not constitute prior art.

Within the lighted sign industry, among others, it is known to utilize a combination of red, green and blue Light-Emitting-Diodes (RGB LED's) to generate a plurality of lighting effects and colors. Although useful in generating multiple color combinations, such systems are often unable to generate true white light that is exceptionally bright. As a result, some manufacturers are designing systems that also include a plurality of separate white LED's that can be selectively activated to achieve better results with white light.

This utilization of two separate light systems each having separate controllers and programming has many drawbacks in terms of material, physical restrictions to the installation, and power consumption costs, along with increased trouble-shooting and design time. Additionally, when using an RGBW LED it is not currently possible to utilize optical lenses with such systems, as doing so would result in discoloration of the produced light. As a result, such systems cannot benefit from the optical enhancements provided by a lens, and cannot combine the waterproof status with the optical enhancement to receive protection from the elements necessary to achieve an IP68 rating.

In addition to the above, and owing to the absence of an optical lens, such systems cannot be used with "shallow box" applications (e.g., displays having a separation distance of less than 2.5 inches between the LED's and the screen) because such systems require a lens to properly distribute the produced light.

The present invention, directed to an RGBW LED with an integrated lens system, differs from the conventional art in a number of aspects. The manner by which will become more apparent in the description which follows, particularly when read in conjunction with the accompanying drawings.

SUMMARY OF THE INVENTION

The present invention is directed to a RGBW LED with integrated lens device. One embodiment of the present invention can include a circuit board having a pair of RGB LED's that are positioned along both sides of a single-color LED. The circuit board and LED's can be positioned onto the top surface of a hardened backer and cables can be routed through the sides of the backer.

In one embodiment, the device can include a unitary clear lens body having a top wall, and a continuous sidewall extending downward from the top wall to form an interior space. Three domes can be formed along the top wall of the lens, and a lip can be formed along the sidewall within the inside surface of the lens. The backer can be positioned within the interior space of the lens along the lip, and each of the LED's can be positioned within the interior space of the lens such that each LED is located within a single dome.

In one embodiment, the backer can include a plurality of openings through which glue or resin can be poured. The glue can fill the interior space of the lens body so as to secure the circuit board, LED's and backer within the lens in a watertight manner.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
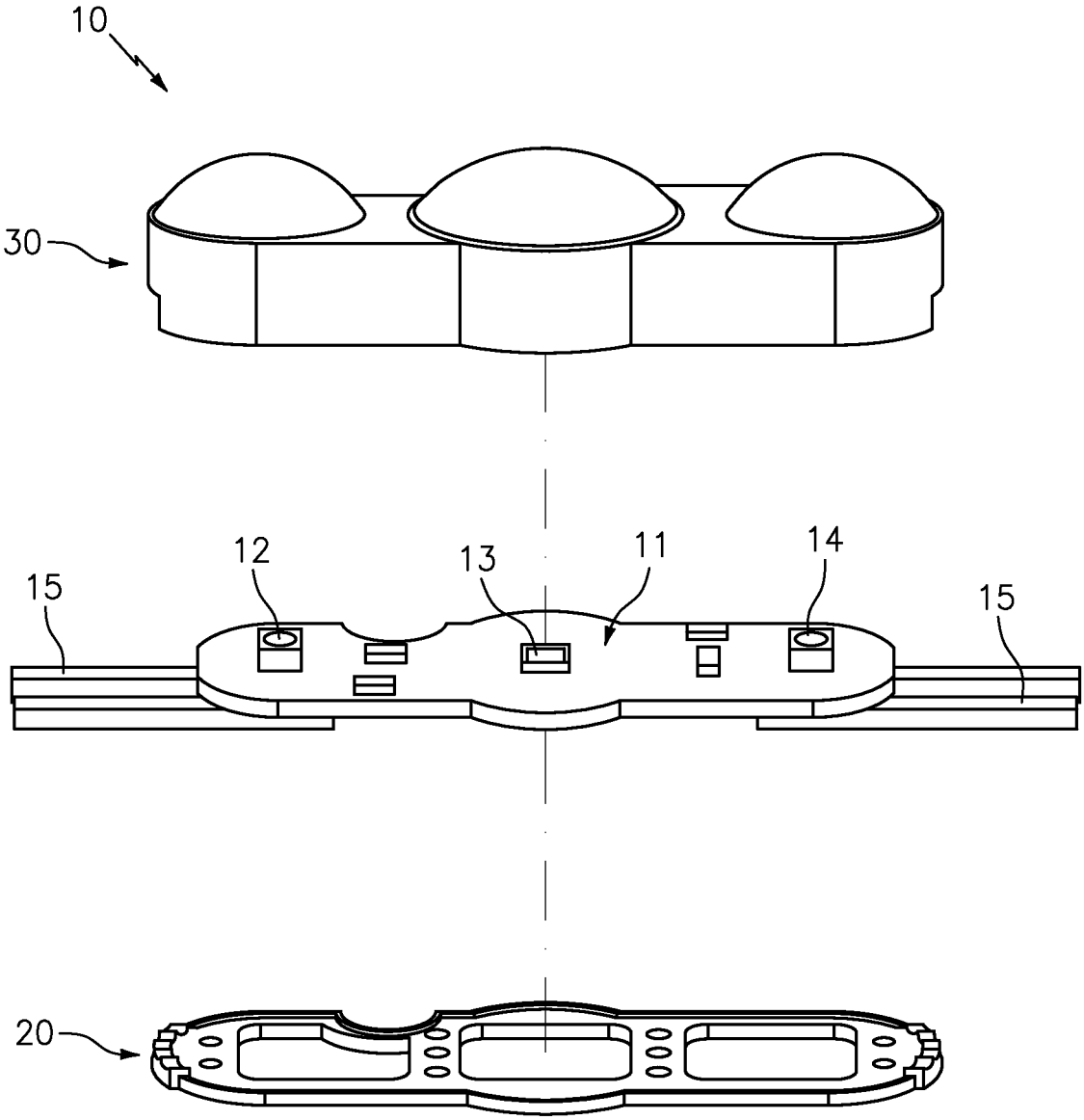
FIG. 1 is an exploded parts view of an exemplary embodiment of a RGBW LED with integrated lens device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described throughout this document, the term "about" "approximately" "substantially" and "generally" shall be used interchangeably to describe a feature, shape or measurement of a component within a tolerance such as, for example, manufacturing tolerances, measurement tolerances or the like.

FIGS. 1-5 illustrate one embodiment of an RGBW LED with integrated lens device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 4A.

FIG. 1 is an exploded parts view of one exemplary embodiment of a RGBW LED with integrated lens device 10. As shown, the device 10 can include, essentially, a circuit board 11, a plurality of LED's 12-14, a backer member 20, and an integrated lens 30.

As described herein, the printed circuit board (PCB) 11 can be constructed from any number of known materials such as fiberglass, composite epoxy, or other laminates, for example, and can include any number of conductive pathways for connecting the LED's and other system components, as are known in the art.

In the preferred embodiment, the plurality of LED's can include one single-color LED 13 that is positioned between two separate RGB LED's 12 and 14. In the preferred embodiment the single-color LED will be white, but any number of other colors are contemplated. As will be described below, each of the LED's 12-14 can be coupled to a single system controller and/or subsequent devices 10 via cables 15, and can function independently or together to create more than sixteen million different color combinations and/or lighting effects.

Although described above as including a specific number and orientation of LED's, along with a particular substrate material, this is for illustrative purposes only. To this end, other embodiments are contemplated wherein a different number and/or orientation of light producing devices are provided. Additionally, any number of other types of circuitry can be used in conjunction with, or instead of the above described PCB.

Figure 2:
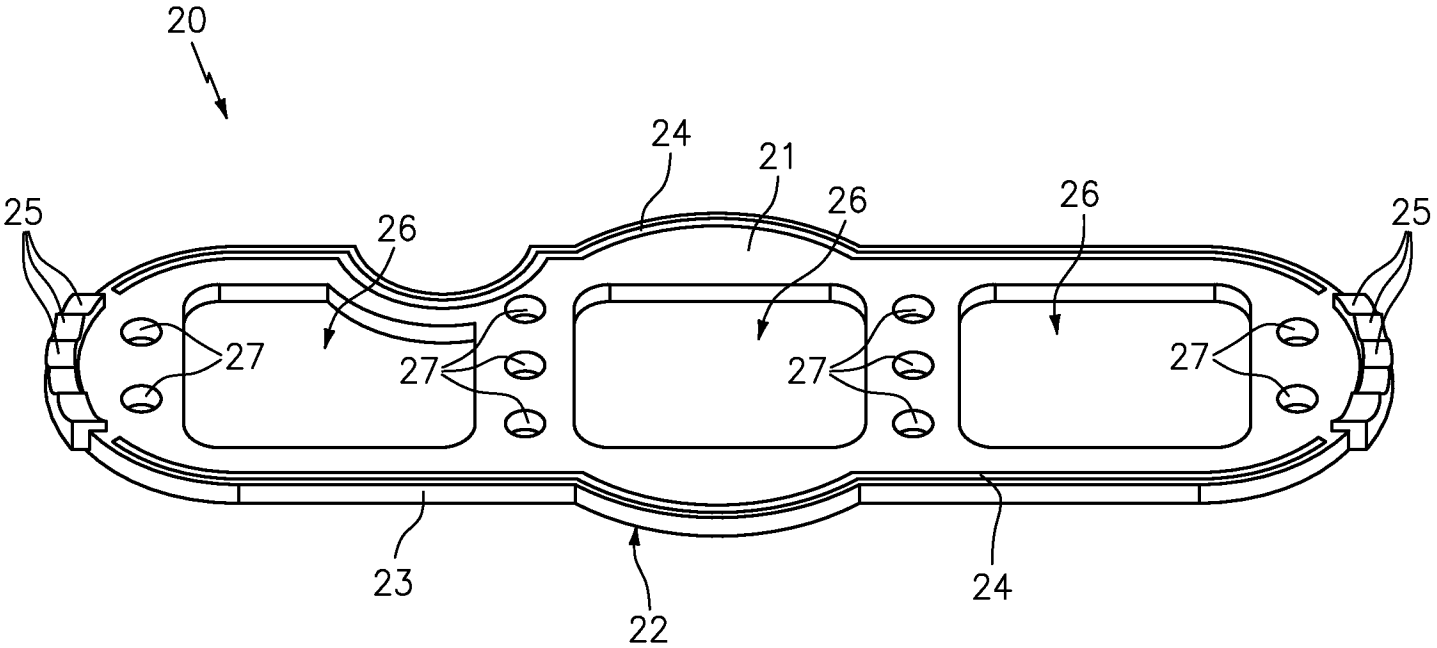
FIG. 2 is a perspective view of the backer portion of the RGBW LED with integrated lens device, in accordance with one embodiment of the invention.

As shown best at FIG. 2, the backer 20 can include an elongated member having a top surface 21, a bottom surface 22, a continuous sidewall 23, a lip 24 that extends above the top surface 21, and a plurality of semi-circular cable guides 25 along each end. The backer can also include a plurality of large openings 26 and a plurality of small openings 27 that extend through the top and bottom surfaces.

In the preferred embodiment, the backer 20 can be constructed from a single piece of hardened and non-conductive material such as Acrylonitrile butadiene styrene (ABS) plastic, for example. Moreover, the above described PCB 11 will preferably include a shape and a size that is complementary to the shape and size of the top surface 21 and lip 24 of the backer 20, so as to be positioned thereon with each of the cables 15 extending along the cable guides 25 Of course, many other shapes, sizes and construction materials are also contemplated.

Figure 3A:
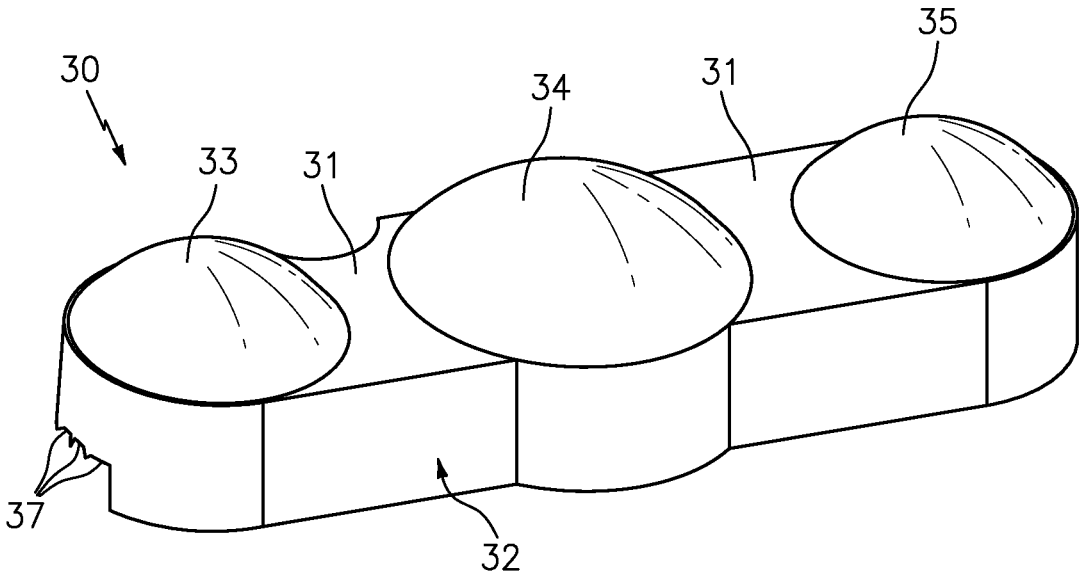
FIG. 3A is an outside perspective view of the lens portion of the RGBW LED with integrated lens device, in accordance with one embodiment of the invention.
Figure 3B:
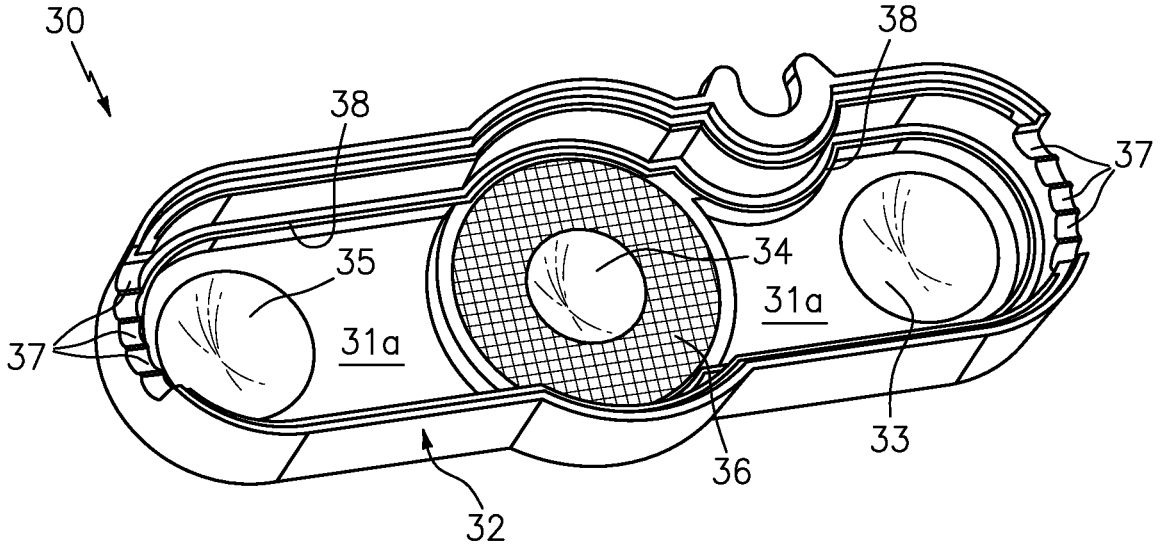
FIG. 3B is an inside perspective view of the lens portion of the RGBW LED with integrated lens device, in accordance with one embodiment of the invention.

As shown at FIGS. 3A and 3B, one embodiment of the integrated lens 30 can include an elongated unitary body having a top wall 31 and a continuous sidewall 32 extending downward from the inside facing surface 31*a* of the top wall. A plurality of light distribution domes 33, 34 and 35 can be formed into the top wall 31 and can extend upward therefrom in a direction opposite to the inside facing surface 31*a*.

In the preferred embodiment, the integrated lens 30 can be constructed from a single piece of molded clear plastic, so as to allow light generated by the LED's to be simultaneously and unobstructedly dispensed 360 degrees from each of the domes 33-35, the top wall 31 and the sidewall 32. Of course, other colors, transparency levels, construction methodologies and/or construction materials are also contemplated.

In one embodiment, a generally circular refractor 36 can be positioned along the inside portion of the top wall 31*a* and can surround the center dome 34. The refractor 36 functioning to enhance the color (preferably white) light produced by the single-color LED 13. Additionally, a plurality of semi-circular cable guides 37 can be disposed along both ends of the lens body. Each of the cable guides 37 preferably including a complementary shape and size to guides 25 of the backer 20, and function together to form openings through which the cables 15 are positioned.

In one embodiment, a continuous lip 38 can be positioned along the inside portion of the sidewall 31. The lip 38 will preferably include a shape and size that is complementary to the shape and size of the lip 24 and sidewall 23 of the backer 20 so as to receive the same.

Figure 4A:
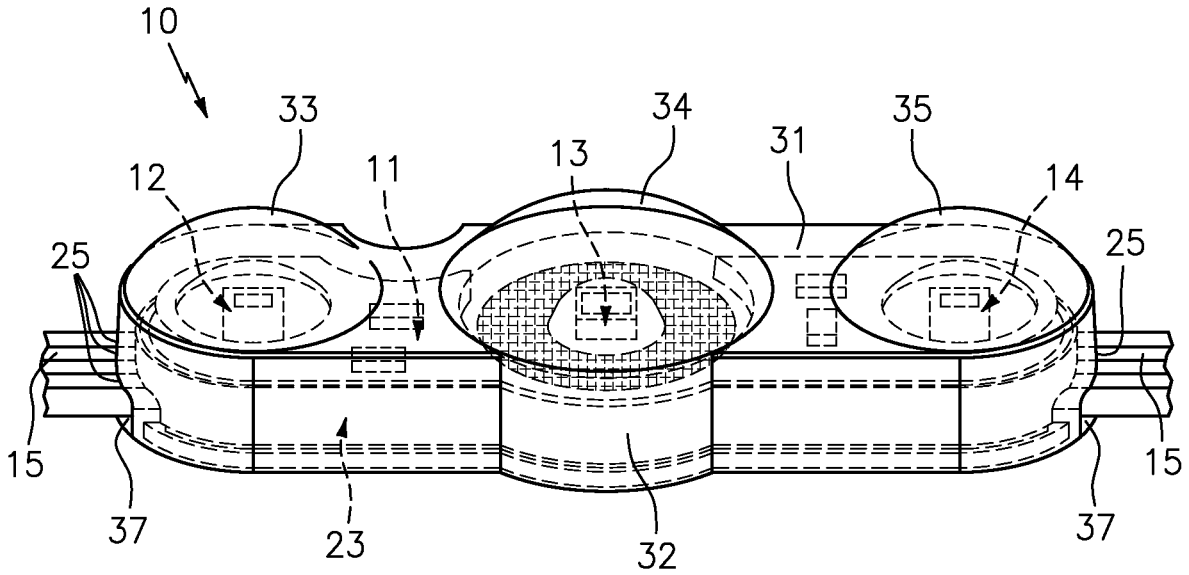
FIG. 4A is a side perspective view of the RGBW LED with integrated lens device, in accordance with one embodiment of the invention.
Figure 4B:
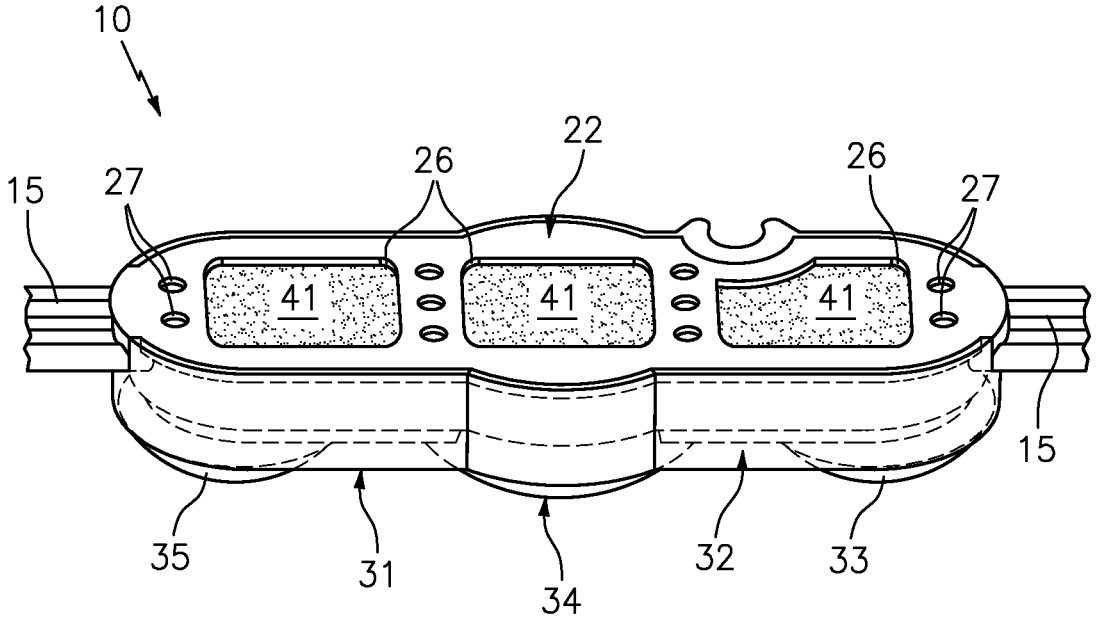
FIG. 4B is a bottom view of the RGBW LED with integrated lens device, in accordance with one embodiment of the invention.

As shown at FIGS. 4A and 4B, when so positioned, the PCB 11 will be adjacent to the inside facing surface 31*a* of the top wall 31 and each of the LED's 12, 13 and 14, will be positioned within or directly below the domes 33, 34 and 35, respectively. At this time, glue 41, resin or other such material can be injected through the large openings 26 and can function to fill the entire interior space of the integrated lens body. As the glue hardens, any bubbles formed by the manufacturing process can escape through the small openings 27.

Such a feature acts to create a continuous, solid and clear insulator located throughout the interior of the device that secures and protects each of the PCB 11, LED's 12-14, wires 15 and backer 20 within the single integrated lens 30, thus allowing the device to achieve an IP68 rating.

Figure 5:
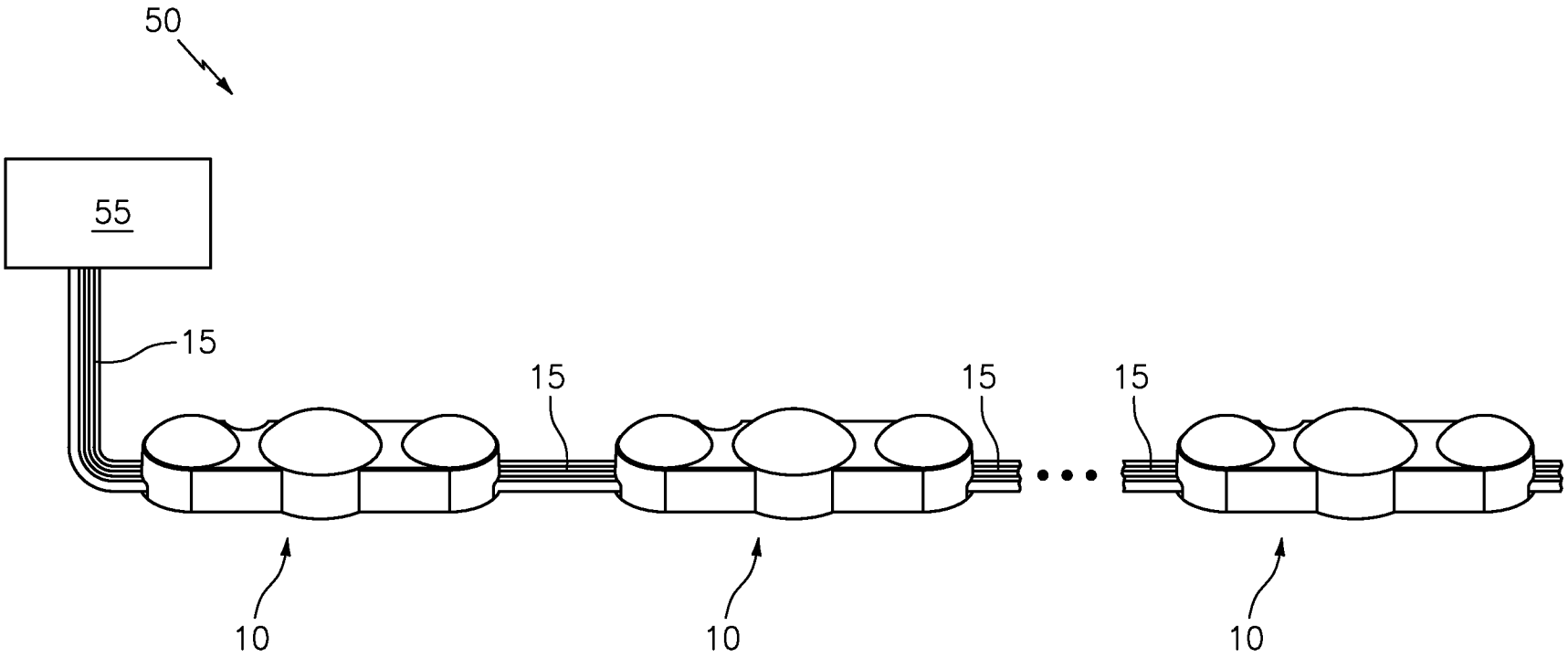
FIG. 5 is a perspective view of a RGBW LED with integrated lens system, in accordance with one embodiment of the invention.

As shown at FIG. 5, a plurality of individual RGBW LED with integrated lens devices 10 can be joined together to form a system 50 that can be connected to a single LED controller 55. As is known in the art, the controller 55 can include circuitry and functionality to selectively engage each LED of each of the devices 10 to create a virtually unlimited number of different colors, and lighting effects.

Because each of the devices 10 include distinct light distribution domes that function as individual lenses tied directly to the individual LED's, each device 10 is capable of generating pure white light in accordance with acceptable industry standards ranging from 2700° K to 9000° k, for example. Through this combination of elements, the domes allow for even light distribution that is not possible with prior known RGBW devices. Importantly, such functionality allows a single system 50 to be utilized in "shallow box" sign applications, which is not possible with prior known devices, as the absence of a lens interferes with the light distributed by the same.

As described herein, one or more elements of the RGBW LED with integrated lens devices 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A light device, comprising:

a plurality of light emitting diodes, wherein at least one of the light emitting diodes in the plurality of light emitting diodes is an RGB light emitting diode, wherein at least one of the light emitting diodes in the plurality of light emitting diodes is a single-color light emitting diode;

a circuit board that is in communication with each of the at least one RGB light emitting diode and the at least one single-color light emitting diode;

a backer having a top surface, and a bottom surface;

a lens having a top wall, a sidewall and an interior space; and a plurality of domes extending outward from the top wall of the lens, wherein the lens and the plurality of domes comprise a unitary construction to allow light generated by the plurality of light emitting diodes to be simultaneously and unobstructedly dispensed 360 degrees from each of the domes, the top wall and the sidewall, wherein the circuit board is positioned along the top surface of the backer, wherein each of the at least one RGB light emitting diode and the at least one single-color light emitting diode are positioned adjacent to the top wall of the lens, and wherein the backer is positioned within the interior space of the lens.

2. The device of claim 1, wherein the unitary lens and plurality of domes are constructed from a clear material.

3. The device of claim 1, wherein the plurality of domes comprises a first dome and a second dome, and wherein the RGB light emitting diode is positioned within the first dome, and the single-color light emitting diode is positioned within the second dome.

4. The device of claim 1, wherein the plurality of domes comprises a first dome, a second dome and a third dome that is positioned along the top wall of the lens.

5. The device of claim 4, wherein the RGB light emitting diode is positioned within the first dome, the single-color light emitting diode is positioned within the second dome, and the another RGB light emitting diode is positioned within the third dome.

6. The device of claim 1, further comprising:

a plurality of cables, each of the plurality of cables being connected to the RGB light emitting diode or the single-color light emitting diode.

7. The device of claim 6, further comprising:

a first plurality of semicircular cable guides that are positioned along the sidewall of the lens; and a second plurality of semicircular cable guides that are positioned along the backer, wherein each of the first plurality of semicircular cable guides and the second plurality of semicircular cable guides include complementary shapes and are configured to form a plurality of individual openings for receiving the plurality of cables.

8. The device of claim 1, wherein the plurality of light emitting diodes comprises another RGB light emitting diode.

9. The device of claim 8, wherein the single-color light emitting diode comprises a single white light emitting diode.

10. The device of claim 9, wherein the single white light emitting diode is positioned between the RGB light emitting diode and the another RGB light emitting diode along the circuit board.

11. The device of claim 1, further comprising:

a refractor that is positioned along an inside portion of the top wall.

12. The device of claim 11, wherein the single-color light emitting diode is positioned within the one of the plurality of domes and above the refractor.

13. The device of claim 1, wherein an inside surface of the plurality of domes and the interior space of the lens are filled with at least one of glue or resin.

14. The device of claim 1, further comprising:

a single system controller that is in communication with the at least one RGB light emitting diode and the single-color light emitting diode, wherein the single system controller includes functionality for controlling an operation of the RGB light emitting diode and the single-color light emitting diode.

15. A light device, comprising:

at least one RGB light emitting diode;

at least one single-color light emitting diode;

a circuit board that is in communication with each of the at least one RGB light emitting diode and the at least one single-color light emitting diode;

a backer having a top surface, and a bottom surface;

a lens having a top wall, a sidewall and an interior space;

a plurality of domes extending outward from the top wall of the lens; and a refractor that is positioned along an inside portion of the top wall;

wherein the circuit board is positioned along the top surface of the backer, wherein each of the at least one RGB light emitting diode and the at least one single-color light emitting diode are positioned adjacent to the top wall of the lens, and wherein the backer is positioned within the interior space of the lens.

16. The device of claim 15, wherein the at least one single-color light emitting diode is positioned within one of the plurality of domes and above the refractor.

* * * * *